US005516417A

United States Patent [19]

Kondou et al.

[11] Patent Number: 5,516,417

[45] Date of Patent: May 14, 1996

[54] METHOD AND APPARATUS FOR APPLYING COMPOSITE PLATING ON HOLLOW MEMBER

[75] Inventors: Takuji Kondou; Yuzo Yoshioka; Hiroaki Mase; Kiyonobu Mizoue; Hisayuki Sakurai; Nobuhiko Yoshimoto; Hiroyuki Nomura, all of Sayama, Japan

[73] Assignee: Honda Giken Kogyo Kabushiki Kaisha, Tokyo, Japan

[21] Appl. No.: 326,372

[22] Filed: Oct. 20, 1994

[30] Foreign Application Priority Data

| | | | |
|---|---|---|---|
| Oct. 22, 1993 | [JP] | Japan | 5-265082 |
| Dec. 3, 1993 | [JP] | Japan | 5-304241 |
| Dec. 3, 1993 | [JP] | Japan | 5-304242 |
| Dec. 3, 1993 | [JP] | Japan | 5-304243 |
| Dec. 3, 1993 | [JP] | Japan | 5-304244 |

[51] Int. Cl.[6] ..... C25D 15/00

[52] U.S. Cl. ..... 205/109; 205/131; 205/148; 204/272; 204/273; 204/277

[58] Field of Search ..... 205/148, 131, 205/110, 109; 204/272, 277, 273

[56] References Cited

U.S. PATENT DOCUMENTS

| | | | |
|---|---|---|---|
| 3,922,208 | 11/1975 | Cordone | 205/97 |
| 3,951,774 | 4/1976 | Vones | 204/272 |
| 4,085,010 | 4/1978 | Ishimori et al. . | |
| 4,441,976 | 4/1984 | Iemmi | 204/224 M |

FOREIGN PATENT DOCUMENTS

| | | |
|---|---|---|
| 52-93636 | 8/1977 | Japan . |
| 1200410 | 7/1970 | United Kingdom . |
| 1236954 | 6/1971 | United Kingdom . |

*Primary Examiner*—John Niebling
*Assistant Examiner*—Brendan Mee
*Attorney, Agent, or Firm*—Armstrong, Westerman, Hattori, McLeland & Naughton

[57] ABSTRACT

A hollow member whose internal surface is to be applied with composite plating is held in a condition in which a generatrix of the internal surface extends vertically. An electrode is inserted into the hollow member with a predetermined clearance to the internal surface of the hollow member. A composite plating liquid supply passage has a discharge opening which is in communication with an opening at a lower end of the hollow member. A gas is entrained in a form of bubbles into a composite plating liquid which is supplied into the clearance through the supply passage.

7 Claims, 9 Drawing Sheets

METHOD AND APPARATUS FOR APPLYING COMPOSITE PLATING ON HOLLOW MEMBER

BACKGROUND OF THE INVENTION

1. Field of the Invention

The present invention relates to a method and apparatus for applying composite plating (or composite coatings) such as one called NIKASIL coating, or plating, on an internal surface of a hollow member such as a cylinder of an engine.

2. Description of Related Art

A cylinder of an engine, for example, is subjected to wear, etc., on its internal side by the sliding of a piston. Therefore, it is necessary to improve the abrasion resistance or wear resistivity of the internal surface of the cylinder especially when a cylinder block is made of an aluminum alloy which easily wears. In the case where openings must be formed on an internal surface of the cylinder such as in a 2-cycle engine of a crank scavenging type, it is difficult to mount by fitting a sleeve inside the cylinder. A composite plating is sometimes applied in such a case. A known method of applying a composite plating on the internal surface of the cylinder, is the so-called NIKASIL plating in which an electrode is inserted into the cylinder with a clearance to the internal surface thereof, the clearance is filled with a composite plating liquid containing ultrafine particles of silicon carbide in a mixture with nickel sulfate, wherein the ultrafine particles of the silicon carbide are contained or enclosed in nickel.

However, in order for the ultrafine particles to be contained in a composite plating layer, the flow velocity of the composite plating liquid cannot be made very large. Therefore, the flow of the composite plating liquid in this clearance becomes a laminar flow. This will be accompanied by the following disadvantage. Namely, on an upstream side of the composite plating liquid, the ultrafine particles of silicon carbide or the like can be well contained inside the composite plating layer. However, on a downstream side, since the content of the ultrafine particles contained in the composite plating liquid close to the internal surface of the cylinder is decreased, the amount of ultrafine particles contained in the composite plating layer decreases. As a result, the composite plating layer becomes nonuniform between the upstream side and the downstream side.

As an art to solve this kind of disadvantage, there is known one by Japanese Published Unexamined Patent Application No. 93636/1977 in which the flow of the composite plating liquid is reversed at every predetermined period of time.

In the above-described art in which the flow of the composite plating liquid is reversed at every predetermined interval of time, there is a disadvantage in that the central portion is difficult of being composite-plated (or plated by the composite plating liquid), though both end portions of the cylinder may be made equal in the plating conditions. This tendency of nonuniform plating increases with the increase in the length of the cylindrical portion.

SUMMARY OF THE INVENTION

In view of the above-described disadvantages, the present invention has an object of providing a method and an apparatus for uniformly applying a composite plating on an internal surface of a hollow member.

In order to attain the above and other objects, the present invention is an apparatus for applying composite plating on an internal surface of a hollow member comprising: an electrode which is inserted into the hollow member with a predetermined clearance to an internal surface of the hollow member, the hollow member being held in a condition in which a generatrix of the internal surface extends vertically; a composite plating liquid supply passage having a discharge opening which is in communication with an opening at a lower end of the hollow member; and means for entraining bubbles of a gas into a composite plating liquid which is supplied into the clearance through the supply passage.

According to another aspect of the present invention, the above and other objects are attained by a method of applying composite plating on an internal surface of a hollow member, the hollow member having inserted therein an electrode with a clearance to the internal surface of the hollow member, the composite plating being carried out by flowing a composite plating liquid through the clearance. The method comprises entraining a gas into the composite plating liquid in a bubbled condition before the composite plating liquid reaches the clearance.

If the flow of the composite plating liquid becomes laminar, composite plating can be effected well on the upstream side of the composite plating liquid, but the composite plating liquid which is in contact with the internal surface of the hollow member flows downstream as it is without exchanging, i,e., without mixing or movement of ultrafine particles from laminar flows near the electrode towards or into laminar flows in contact with or close to the surface of the hollow member. On the downstream side, the content of the ultrafine particles contained in the composite plating liquid which is in contact with the internal surface becomes smaller and, therefore, composite plating hardly takes place. Here, as in the present invention, by entraining bubbles of a gas into the composite plating liquid, the bubbles adhere to the internal surface of the hollow member and to the electrode. These bubbles become obstacles to the flow of the composite plating liquid, thereby giving rise to the formation of turbulences behind the bubbles. Or else, the composite plating liquid is agitated by the upward movement of the bubbles. As a result, the flow of the composite plating liquid inside the clearance becomes turbulent. The composite plating liquid containing ultrafine particles therein is, thus, also supplied to the downstream side of the internal surface. The composite plating layer consequently becomes uniform.

If the discharge opening is provided with a restricted passage portion whose internal diameter is equal to or smaller than the outer diameter of the electrode, most of the bubbles contained in the composite plating liquid once strike the lower end of the electrode. The bubbles, then, will adhere to the surface of the electrode and rise along the clearance while adhering to the surface of the electrode. When the bubbles move upwards, the bubbles displace or move sidewise the composite plating liquid which is present above the bubbles. Therefore, that composite plating liquid containing a large amount of ultrafine particles which is present near the surface of the electrode is, thus, pushed sidewise towards the internal surface of the hollow member. By this movement, the composite plating liquid containing therein a large amount of ultrafine particles is supplied to the entire region of the internal surface, whereby the content of the ultrafine particles inside the composite plating layer becomes further uniform.

By the way, if the direction of movement of the bubbles suddenly changes when the bubbles stricken and adhered to the lower end of the electrode move upwards along the surface of the electrode, there is a possibility that the bubbles are peeled off or away from the surface of the electrode. As a solution, the lower end portion of the electrode may be made smaller in diameter towards the lower end thereof. The peeling off of the bubbles can thus be prevented by avoiding a sudden change in direction of movement of the bubbles.

If the amount of entrainment of the gas is below 12 % by volume, a sufficient agitating effect cannot be obtained. If the amount of entrainment of the gas exceeds 95% by volume, the composite plating cannot be made any more because the entire clearance is filled with the gas and, therefore, the internal surface and the electrode are electrically insulated by the gas. Therefore, it is preferable to limit the amount of gas to be entrained to 12 to 95% by volume of the composite plating liquid.

When the hollow member such as a cylinder or the like is made of a material which can be oxidized relatively easily and air is used as the gas, there is a possibility that the internal surface thereof is oxidized by the oxygen contained in the bubbles of air. If the internal surface is oxidized, the NIKASIL plating to be formed or applied thereon is likely to be peeled off from the oxidized portion which functions as a starting point of peeling off. Here, since nickel or the like which is used as the mother metal of the composite plating is relatively hardly oxidized, the following operation becomes possible. Namely, composite plating is carried out without entraining air for a predetermined period of time after starting the composite plating. A coating of the composite plating layer is thus applied to the internal surface to attain a condition in which an oxidized film cannot be formed even if the bubbles of air come into contact. Thereafter, air is entrained to form a uniform composite plating layer. The composite plating layer to be formed without entraining air may not be uniform, but there is no problem because the composite plating layer to be formed thereafter will become uniform by the entrainment of the air.

If the size of the bubbles of a gas is made large enough to contact both the internal surface of the hollow member and the surface of the electrode, the composite plating liquid which is agitated and displaced by the bubbles when they move upwards along the clearance can surely be made to reach the internal surface of the hollow member. The composite plating liquid can thus be completely agitated. However, there will arise a disadvantage in that the area of contact of the composite plating liquid with the internal surface and the surface of the electrode becomes smaller. As a result, the electric current will not flow between the internal surface and the electrode, and the composite plating itself can no longer be carried out. As a solution to this disadvantage, the following arrangement may be employed. Namely, when the bubbles are entrained and the composite plating liquid has been agitated, the entrainment of the gas is once stopped. The composite plating is carried out by sufficiently flowing the electric current in a condition in which there is no bubble in the clearance. Once the composite plating has been made to a certain degree, the composite plating liquid is again agitated by the bubbles. A uniform composite plating can thus be made by the coexistence of operations of agitating the composite plating liquid and of carrying out the composite plating.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
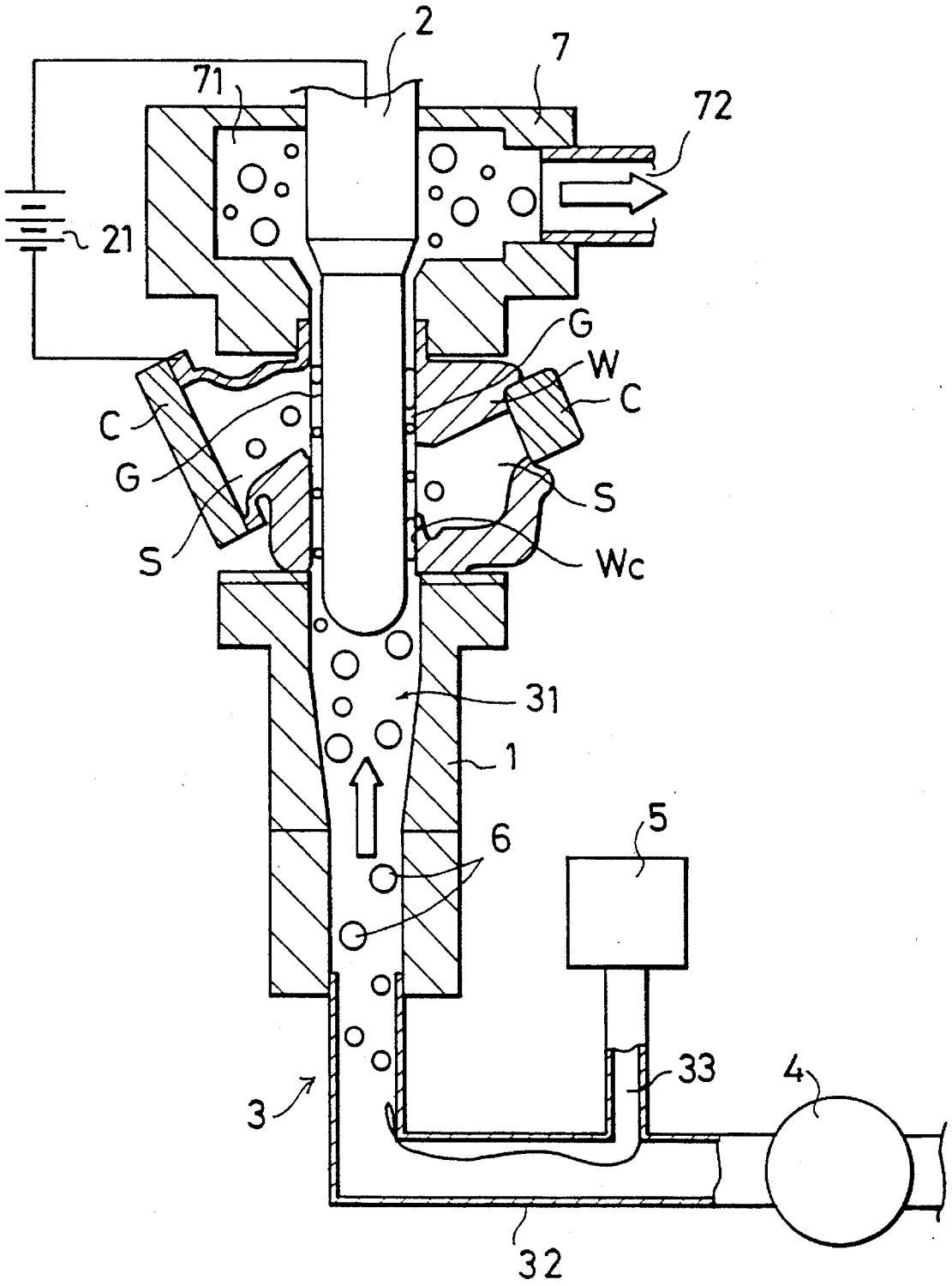
FIG. 1 is a schematic view showing the arrangement of a first example of a composite plating apparatus according to the present invention.

A first example is explained with reference to FIG. 1, wherein letter W represents a cylinder block, made of an aluminum alloy, for a 2-stroke engine. This cylinder block W is provided with a cylinder Wc which penetrates or passes vertically through the cylinder block W, as well as spaces S provided to open into the cylinder Wc, for scavenging and exhausting, respectively. These spaces S are hermetically closed to the outside by caps C. The cylinder block W is mounted on a supporting base 1. Into the cylinder Wc there is inserted an electrode 2 from an upside. An electric power source 21 is connected to the cylinder block W and the electrode 2. Between the electrode 2 and the internal surface of the cylinder Wc, there is formed a clearance G so that a composite plating liquid to be supplied from a composite plating liquid supply passage 3 can flow through the clearance G. This composite plating liquid supply passage 3 is formed by a discharge port 31 which is formed in the supporting base 1 and is in communication with an opening at a lower end of the cylinder Wc, and a connection tube 32 which connects the discharge port 31 to a pump 4 for supplying the composite plating liquid. In an intermediate portion of the connection tube 32 there is connected an air entraining or mixing passage 33. To this air entraining passage 33 there is connected an air compressor 5 so that a predetermined amount of air can be entrained or mixed into the composite plating liquid inside the composite plating liquid supply passage 3. The air thus entrained flows upwards in the form of bubbles 6 together with the composite plating liquid through the composite plating liquid supply passage 3 and flows into the above-described clearance G. After flowing through the above-described clearance G, the composite plating liquid flows into a space 71 of a pushing member 7 which pushes the upper surface of the cylinder block W. The composite plating liquid then flows into an unillustrated tank for discharging the air via a passage 72 and is again fed to the connection tube 32 by the pump 4.

In this first example as well as in the following examples, there was used as the composite plating liquid a liquid, whose pH is 4, obtained by mixing 400 grams of nickel sulfate, 35 grams of boric acid, 60 grams of ultrafine particles of silicon carbide and 2.5 grams of sodium saccharin as an additive for adjusting the hardness to each 1 liter of water. It is thus so arranged that nickel containing ultrafine particles of silicon carbide is composite-plated in the form of so-called NIKASIL plating. Unless otherwise specified, the conditions for composite plating are as follows, i.e., the flow velocity of the composite plating liquid through the clearance G without entrainment of air is 15 cm/s, the temperature of the composite plating liquid is 60° C., and the density of the cathode electric current is 0.28 $A/cm^2$.

Figure 2:
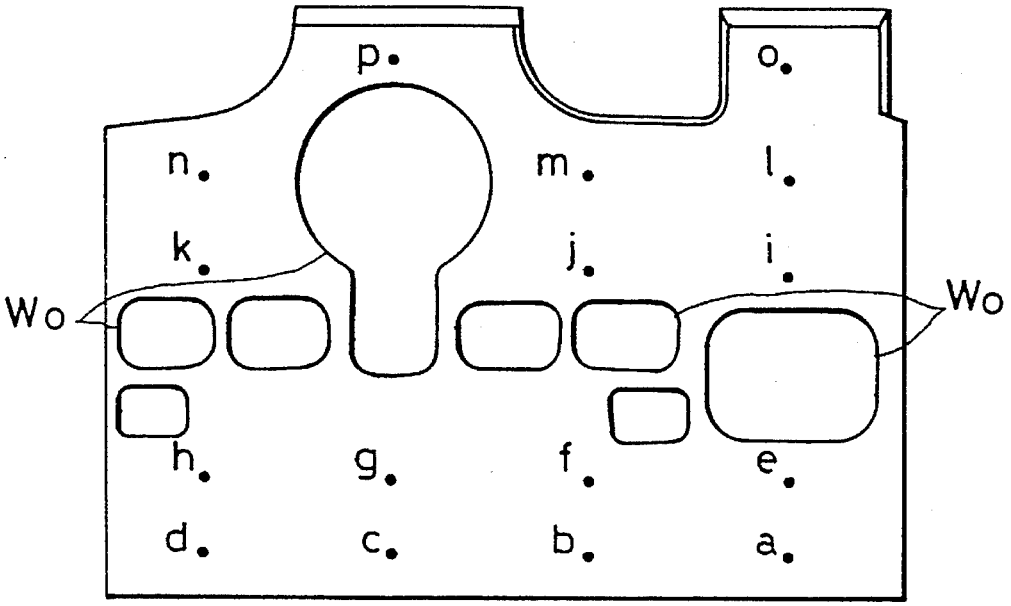
FIG. 2 is a development of a cylinder Wc.
Figure 3:
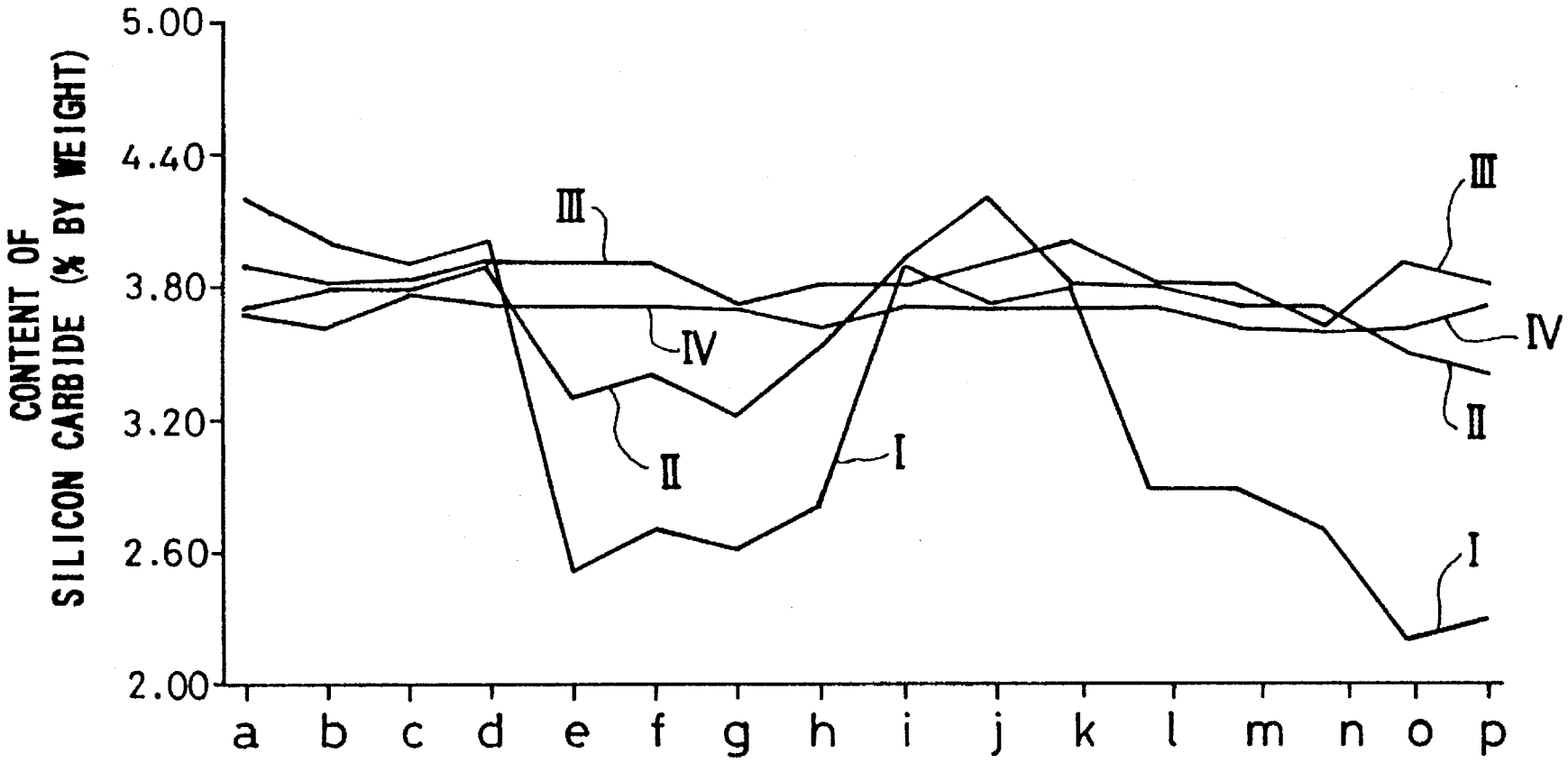
FIG. 3 is a graph showing the content of silicon carbide at points "a" through p in a composite plating layer.

Referring to FIGS. 2 and 3, an explanation will now be made about the results of composite plating as formed by using the above-described apparatus. FIG. 2 shows a development of the cylinder Wc. The results of plating treatment at each point "a" through p in FIG. 2 are shown in FIG. 3. In this example, along the flow direction of the composite plating liquid, there appear the differences in the amount of silicon carbide contained in the composite plating layer more conspicuously than the thickness of the composite plating layer. Further, the abrasion resistance of the composite plating layer largely varies with the amount of silicon carbide contained. Therefore, the amount of silicon carbide contained in each of the points "a" through p were measured, and the results of the measurement are shown in FIG. 3 in which the ordinate represents the content by weight % of silicon carbide. Curves I through IV show the results when the amount of air entrainment was increased or decreased relative to the flow amount of the composite plating liquid of 264 $cm^3/s$. Curve I shows a case in which no air was entrained, curve II shows a case in which air was entrained at a rate of 32 $cm^3/s$ (about 12% by volume), curve III shows a case in which air was entrained at a rate of 70 $cm^3/s$ (about 27% by volume), curve IV shows a case in which air was entrained at a rate of 160 $cm^3/s$ (about 61% by volume). It has been confirmed that the same results were attained even if the amount of air entrainment were increased beyond 160 $cm^3/s$ up to 250 $cm^3/s$ (about 95% by volume).

In the case of curve I, the content of silicon carbide becomes smaller on the downstream side than on the upstream side (a·b·c·d→e·f·g·h and i·j·k→l·m·n). However, once the opening Wo is passed, the content of silicon carbide increases again (e·f·g·h→i·j·k). The reason is considered to be that the flow of the composite plating liquid becomes initially a turbulent flow at the opening Wo and is agitated. When the amount of air entrainment is increased from curve II towards curve IV, the composite plating liquid is agitated by the bubbles and therefore a uniform composite plating is able to be applied over the entire area of the cylinder Wc.

Figure 4:
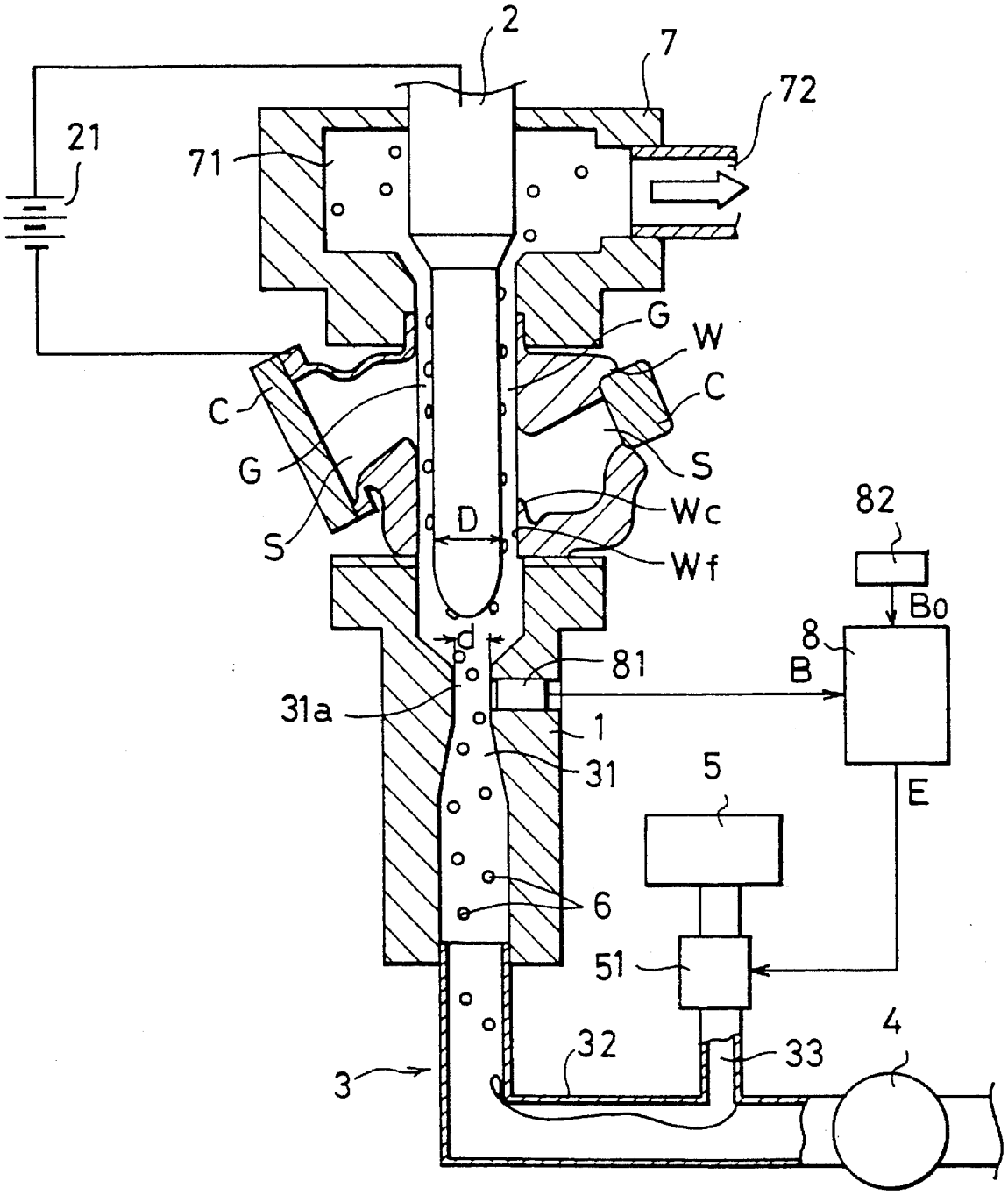
FIG. 4 is a schematic view showing the arrangement of a second example of the composite plating apparatus according to the present invention.

An explanation will now be made about a second example with reference to FIG. 4. The members and/or parts that are the same as or equivalent to those shown in the first example are given the same letters and/or numerals. The same also applies to the third and fourth examples to be described hereinbelow. The composite plating liquid passage 3 is connected to the pump 4 for supplying the composite plating liquid via the connection pipe 32. To the air entraining passage 33 there is connected the air compressor 5. A predetermined amount of air is entrained or mixed into the composite plating liquid inside the connection tube 32 via a solenoid proportional valve 51. The discharge port 31 is provided with a restricted or narrow passage portion 31*a*. Where the diameter of the electrode 2 is D, and the internal diameter of that restricted passage portion 31*a* of the composite plating liquid supply passage 3 which faces the electrode 2 is d, the sizes of the two have been made to satisfy the relationship of D>d.

Figure 5:
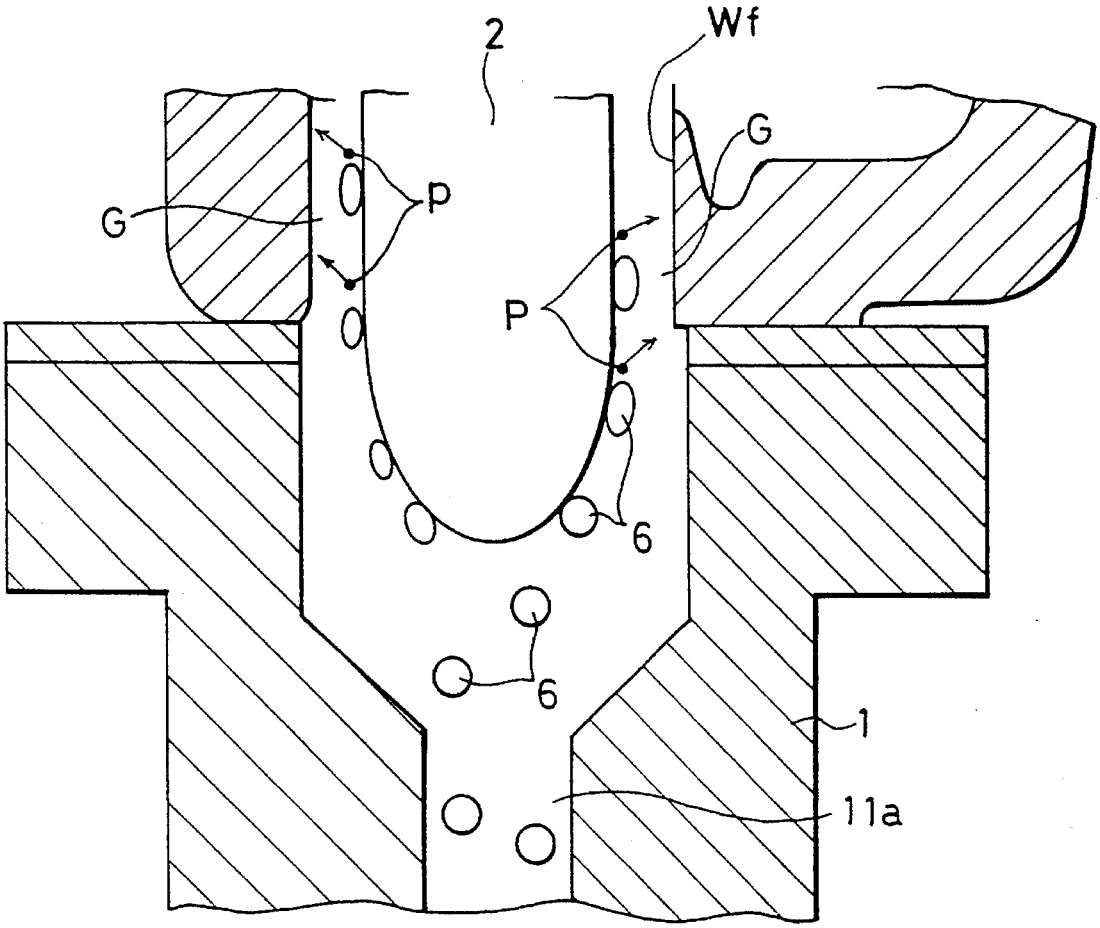
FIG. 5 is a partially enlarged view showing the details of bubbles adhered to the surface of an electrode.

If a setting is made such that D>d, the bubbles in the composite plating liquid to be discharged out of the restricted passage portion 31*a* mostly strike the lower end of the electrode 2 and thus adhere to the surface thereof, as shown in FIG. 5. Since the lower end of the electrode 2 is formed substantially into a hemisphere, the bubbles 6 once adhered to the surface of the electrode 2 will move upwards while adhering to the surface thereof without peeling off or away from the surface. At this time, that composite electrode plating liquid which is located above the bubbles 6 adhering to the surface of the electrode 2 and which contain therein sufficient ultrafine particles is pushed or displaced sidewise towards the internal surface Wf by the upward movement of the bubbles 6. The bubbles 6 move upwards along the surface of the electrode 2 to that portion of the electrode 2 which corresponds to the upper end of the cylinder Wc. Therefore, the composite plating liquid containing therein a large amount of ultrafine particles is supplied from the side of the electrode 2 towards the internal surface Wf of the cylinder Wc over the entire region of the internal surface Wf, thereby obtaining a uniform composite plating layer.

In the above example, the internal diameter d of the restricted passage portion 31*a* was made smaller than the diameter D of the electrode 2. However, they may be made in the same dimensions. Even in such a construction, all of the bubbles 6 can also be made to adhere to the surface of the electrode 2.

In the restricted passage portion 31*a*, there is provided a bubble sensor 81 so as to detect the amount B of air entrained in the composite plating liquid, based on the number and the size of the bubbles 6 to pass through the restricted passage portion 31*a*. The bubble sensor 81 is of a type in which ultrasonic echoes emitted are recognized, such as the one to be used in the ultrasonic testing or the like. It may of course be of an optical type sensor or the like. The detected signal of the bubble sensor 81 is inputted to a controller 8. To the controller 8 there is connected a setting device 82. The controller 8 determines the opening degree E of the solenoid proportional valve 51 in response to the amount Bo of air entrained which is set by the setting device 82 and feed-back controls the opening degree E of the solenoid proportional valve 51 based on the signal detected by the bubble sensor 81.

Figure 6:
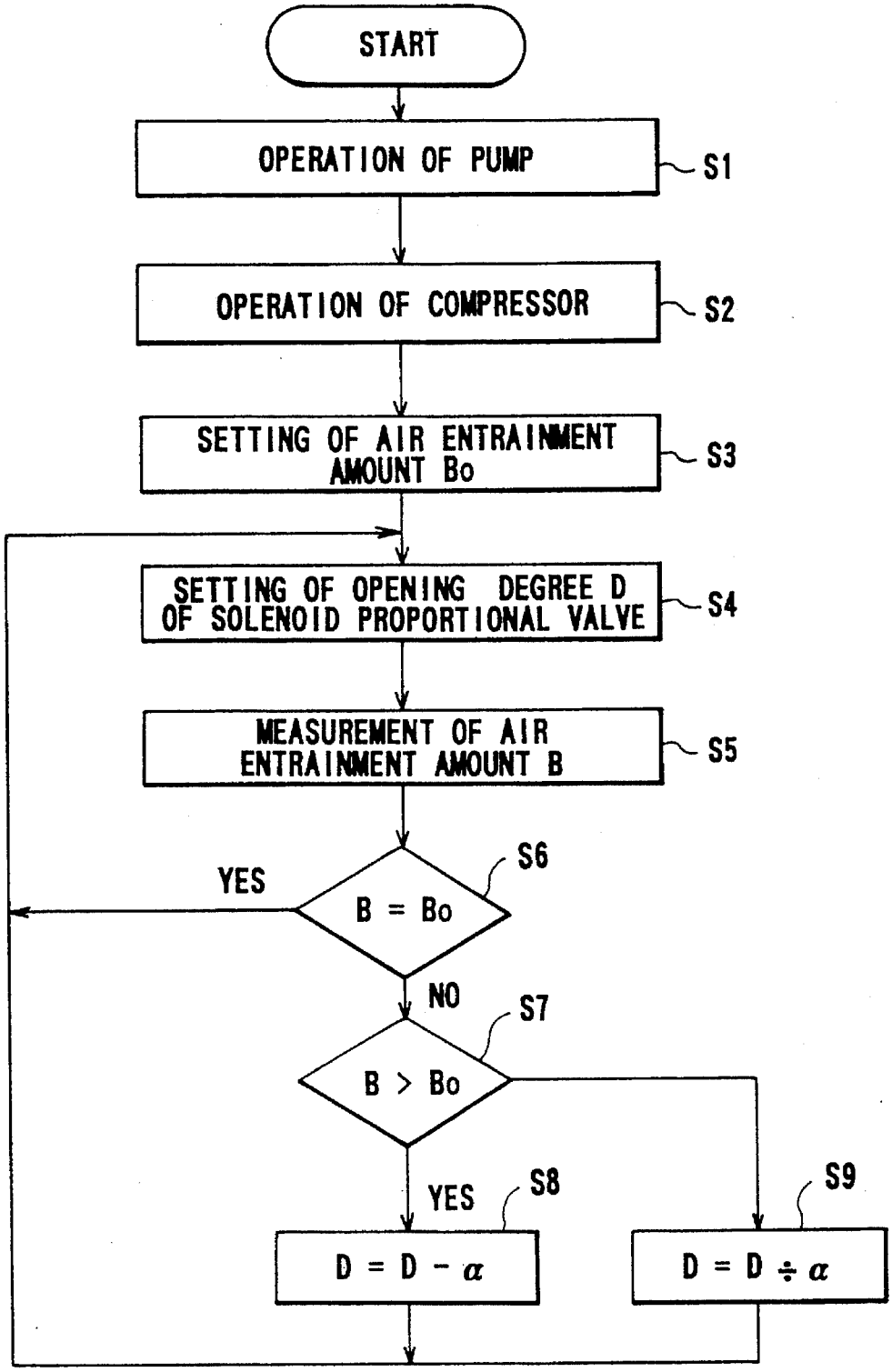
FIG. 6 is a flow diagram showing the operation of the composite plating apparatus.

The operation according to the above-described arrangement will now be explained with reference to FIG. 6. First, the pump 4 and the compressor 5 are started in operation (S1, S2). A setting value Bo of the amount of air entrainment is set by the setting device 82 (S3). The controller 8 will then compute that opening degree E of the solenoid proportional valve 51 which corresponds to the setting value Bo and outputs a signal corresponding to the opening degree E of the solenoid proportional valve 51 (S4). Since the solenoid proportional valve 51 attains an opening degree of E, the air actually gets entrained, and the amount B of the air actually entrained is detected by the bubble sensor 81 and is inputted to the controller 8 (S5). The controller 8 determines or judges whether or not the detected amount B corresponds to the set value Bo (S6). If B=Bo, the opening degree E at that instant is maintained. If B>Bo, the opening degree E is decreased by a predetermined amount α (S7, S8) and if, on the other hand, B<Bo, the opening degree E is increased by a predetermined amount α (S7, S9). The opening degree E of the solenoid proportional valve 51 is thus feed-back controlled such that the amount B of air actually entrained corresponds to the setting value Bo.

Figure 7:
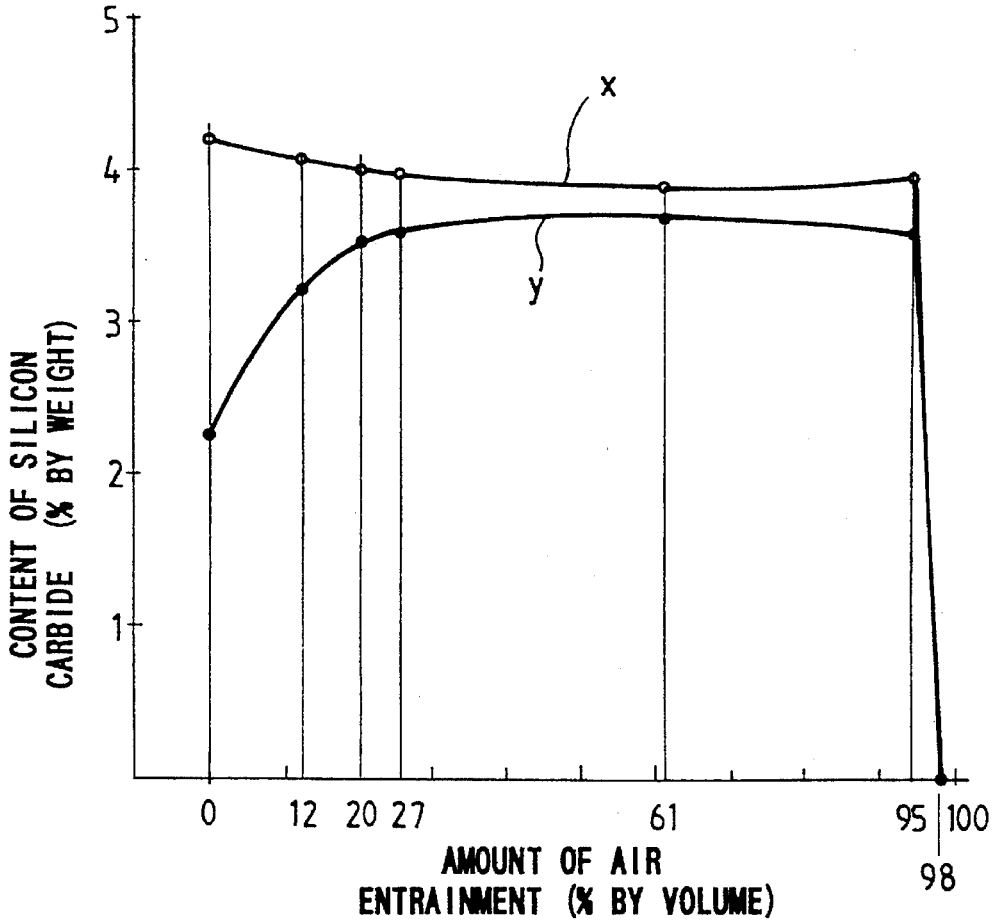
FIG. 7 is a graph showing the dispersion in the content of silicon carbide in the composite plating layer.

Referring to FIG. 7, an explanation will now be made about the condition of the composite plating when the amount of air entrainment is varied. In FIG. 7, the maximum value among the measured values of the content of silicon carbide is represented by x and the minimum value thereof is represented by y. As can be seen from FIG. 7, when air is not entrained at all, the dispersion of the content of silicon carbide is large and, further, the minimum value is extremely small as compared with those under different conditions. However, once 12% of air got entrained, the minimum value of the silicon carbide rapidly approaches the maximum value, and the width of the dispersion becomes smaller. When the amount of air entrainment is increased to 20%, 27%, 61% and 95%, the width of the dispersion is also small and a uniform composite plating can be applied to the internal surface Wf. It is to be noted that, once the amount of air entrainment is increased up to 98%, the composite plating itself can no longer be applied. The reason for this phenomenon is considered to be due to the fact that the electric current will not flow because the clearance G is filled too much with air.

Figure 8:
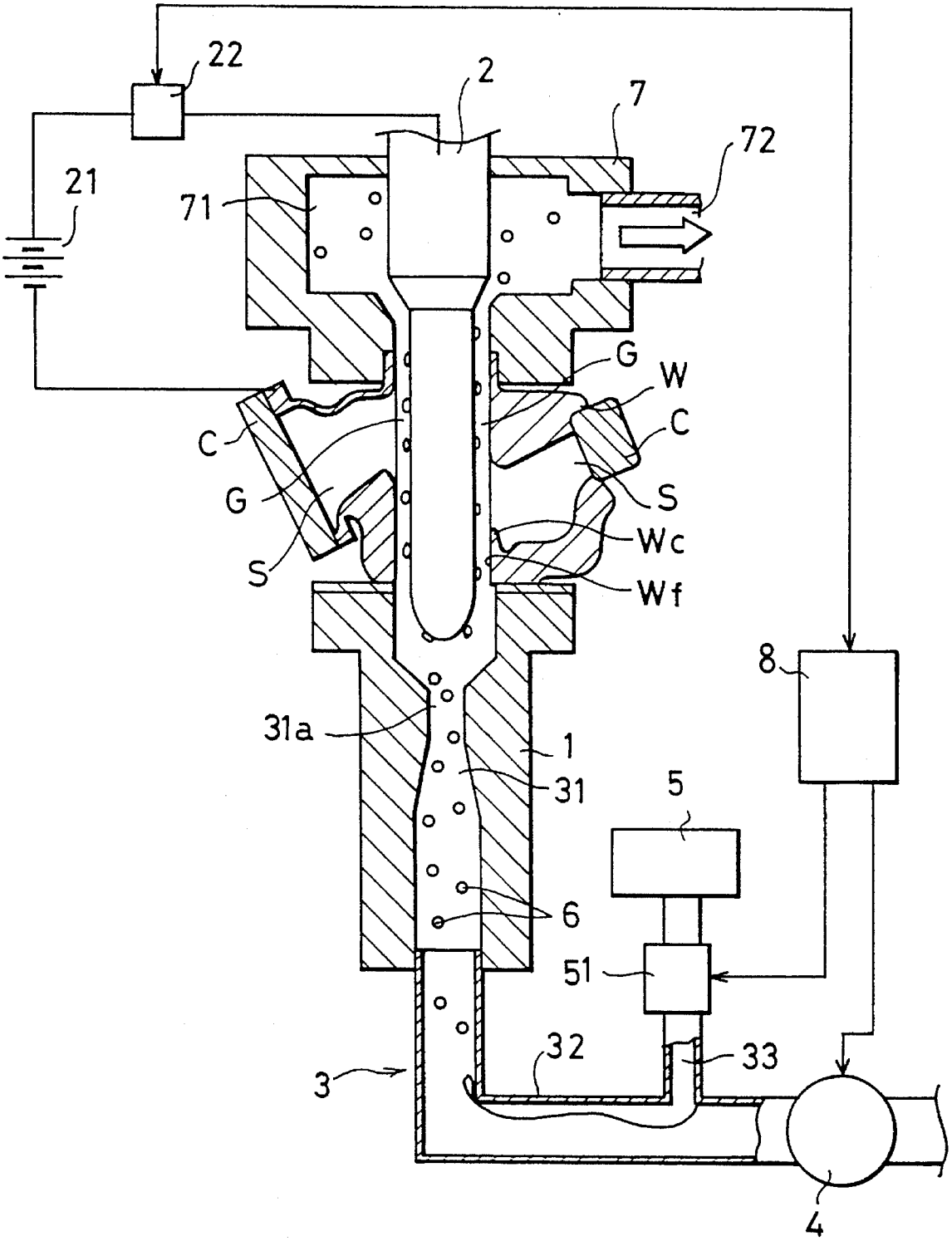
FIG. 8 is a schematic view showing the arrangement of a third example of the composite plating apparatus according to the present invention.

An explanation will now be made about a third example by reference to FIG. 8. Between the electric power source 21 and the electrode 2 there is interposed an electric current control circuit 22 which variably controls the electric current value. This electric current control circuit 22 is controlled by the controller 8. This controller 8 is arranged to control the opening and closing of the solenoid proportional valve 51 and the operation of the pump 4.

Figure 9:
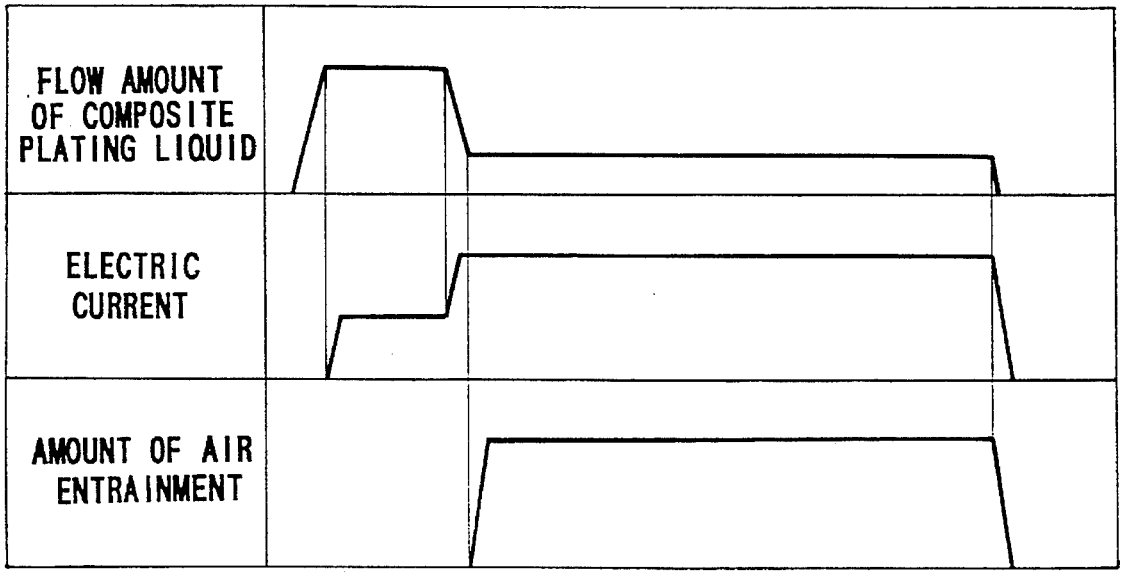
FIG. 9 is a diagram showing the timing of operation of the composite plating apparatus.

The operation of the apparatus according to this arrangement will now be explained with reference to FIG. 9. In starting the composite plating, the pump 4 is started in operation. The flow amount of the composite plating liquid is made to be 845 $cm^3/s$ (corresponding to a flow velocity of 48 cm/s in the clearance G). When the flow amount has become stable, the electric current of 36 A (corresponding to a cathode current density of 0.14 $A/cm^2$) is made to flow via the electric current control circuit 22 to carry out the composite plating. When this condition is maintained for about 60 seconds, the composite plating of 2–3 μm thick is applied or coated to the surface of the internal surface Wf. However, since the flow velocity in the clearance G is large and the electric current is small, little or no ultrafine particles of silicon carbide are contained in the composite plating layer to be coated this time. Instead, only nickel is plated. After this condition has been attained, even if the bubbles come into contact with the internal surface of the cylinder, there will be formed no oxidized coating film thereon. Then, the flow amount of the composite plating liquid is reduced to 264 $cm^3/s$ (corresponding to the flow velocity of 15 cm/s in the clearance G) and the electric current is increased to 72 A (corresponding to a cathode current density of 0.28 $A/cm^2$). When the flow velocity of the composite plating liquid has become stable, the solenoid proportional valve 51 is opened to start the air entrainment. The amount of air entrainment may be 12 to 95% by volume of the flow amount of the composite plating liquid. In this example, 158 $cm^3/s$ (about 60% by volume) was employed. After maintaining this condition until the thickness of the composite plating layer becomes about 120 μm, the pump 4 was stopped and the solenoid proportional valve 51 was closed. The electric current is cut off by the electric current control circuit 22 to finish the composite plating process.

Figure 10:
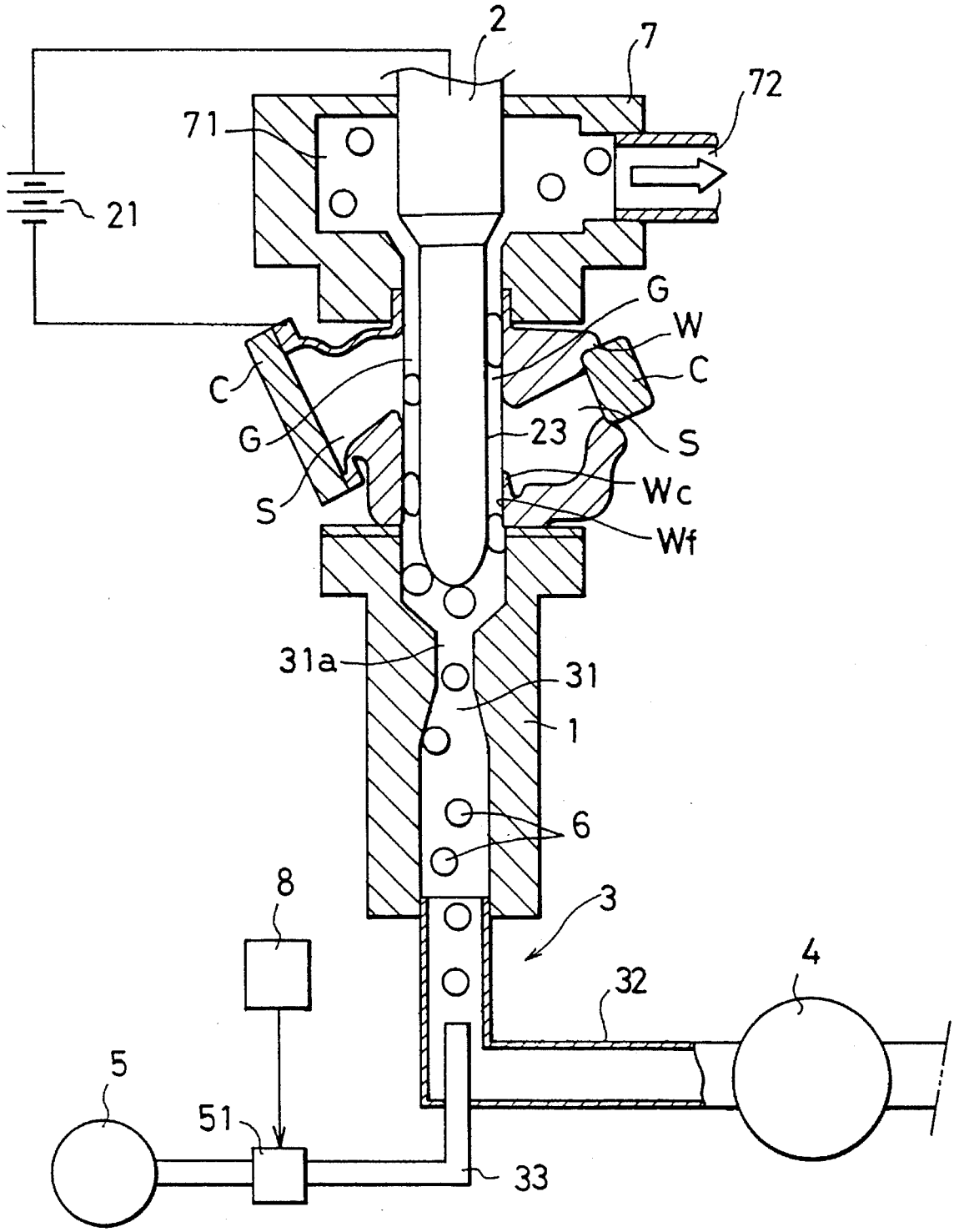
FIG. 10 is a schematic view showing the arrangement of a fourth example of the composite plating apparatus according to the present invention.

Referring to FIG. 10, an explanation will now be made about a fourth example. In this example, the air entraining passage 33 is provided so as to discharge air in the same direction as the flow direction of the composite plating liquid. To this air entraining passage 33 there is connected the compressor 5. The air gets entrained from the air entraining passage 33 into the composite plating liquid inside the connection pipe 32 by opening the solenoid proportional valve 51. In this example, the controller 8 is set such that the solenoid proportional valve 51 is opened at every predetermined interval of time to entrain the air bubbles 6 into the composite plating liquid.

Figure 11:
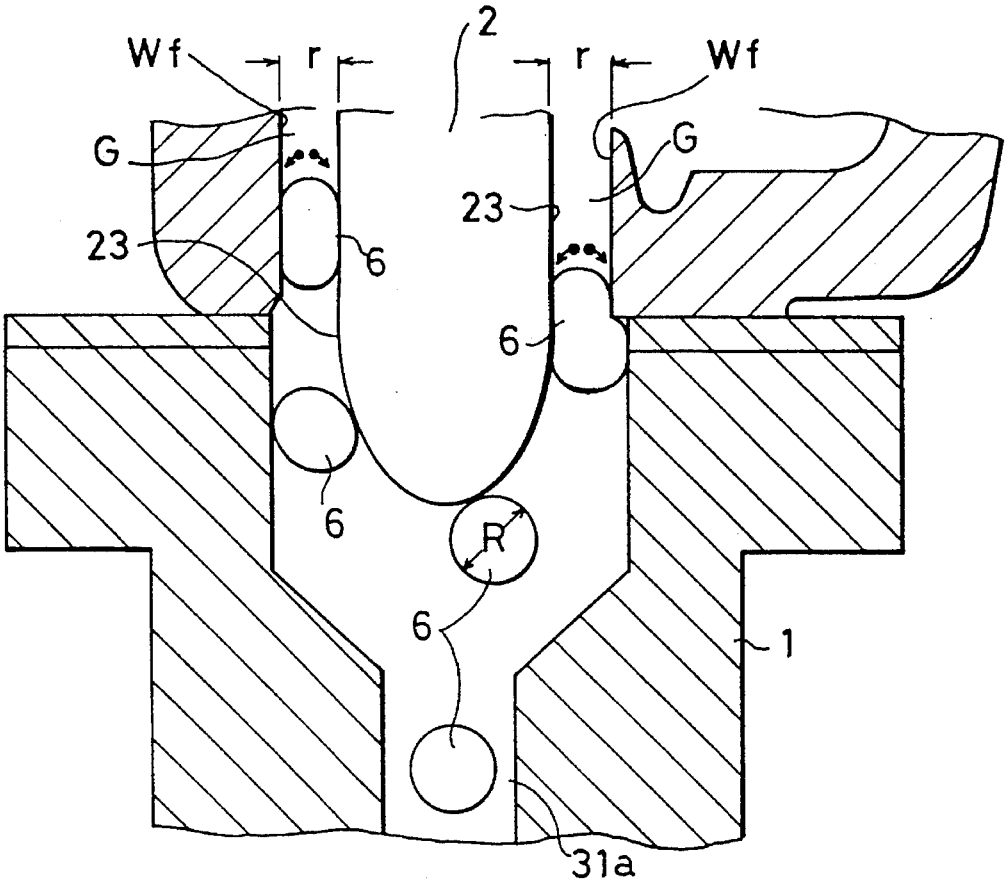
FIG. 11 is a partially enlarged view showing a condition of bubbles in the clearance.

Adjustments are made to the diameter of the discharge opening of the air entraining passage 33, the discharge velocity of the air relative to the flow velocity of the composite plating liquid, or the like. It is thus so set that, as shown in FIG. 11, the diameter R of the air bubbles 6 becomes larger than the distance r in the clearance G. If R>r as described above, when the air bubbles 6 enter the clearance R, they 6 come into contact with both the surface of the electrode 23 and the internal surface Wf. As a result, the bubbles 6 displace the composite plating liquid present above each bubble 6 both towards the surface of the electrode 23 and towards the internal surface Wf, thereby agitating the composite plating liquid.

On the other hand, if the air bubbles 6 thus contact both the surface of the electrode 23 and the internal surface Wf, the electric current will not flow between the internal surface Wf and the electrode 2 at the point of contact, with the result that the composite plating layer will no longer be formed on the internal surface Wf. Therefore, after the air is entrained by the controller 8 to thereby agitate the composite plating liquid by the air bubbles 6, the air entrainment is once stopped to carry out the composite plating for a predetermined period of time in a condition in which the clearance G is free from air bubbles 6. By the time when the composite plating liquid becomes nonuniform, the air is entrained again for a predetermined period of time. Thereafter, these processes are repeated to intermittently continue the air entrainment. As a result, uniform composite plating liquid can be supplied to the entire region of the internal surface Wf and, further, the electric current flows between the internal surface Wf and the electrode 2, thereby applying a uniform composite plating layer on the internal surface Wf.

Figure 12:
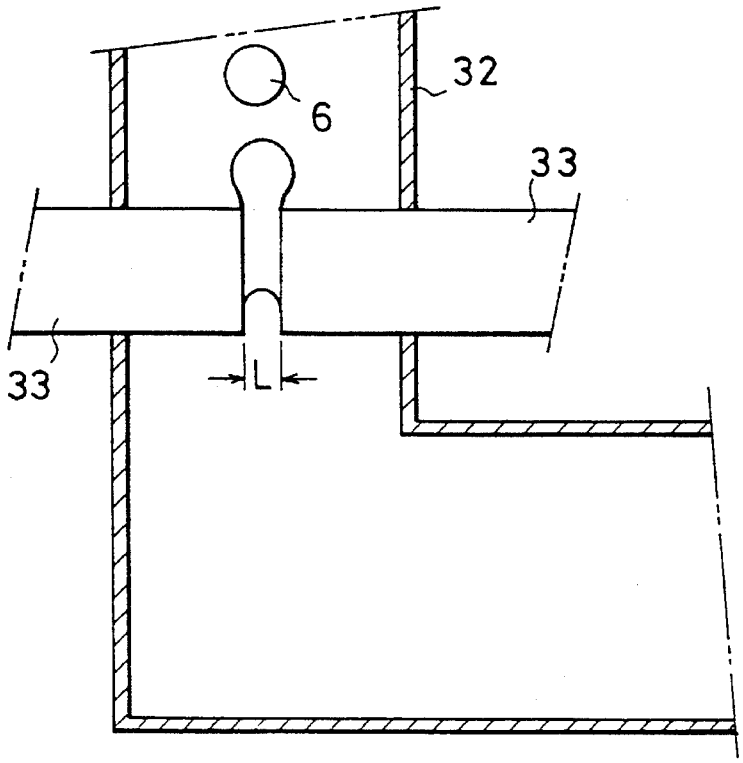
FIG. 12 is a schematic view showing another example of an air entraining passage according to the present invention.

In this example, the air entraining passage 33 is provided such that the air is discharged towards the flow direction of the composite plating liquid. However, as shown in FIG. 12, two air entraining passages 33 may be disposed such that the front end of one faces that of the other with a distance L therebetween at right angles to the flow direction of the composite plating liquid. By employing this arrangement, the diameter of the air bubbles 6 can be adjusted by varying the distance L. In case where the flow velocity of the composite plating liquid has been changed or the like, the diameter of the air bubbles 6 can be made most appropriate without changing the air entraining passage 33.

In each of the above-described examples, air was entrained into the composite plating liquid. However, except the above third example, helium gas, argon gas, nitrogen gas or other inert gases may be entrained instead of air.

It is readily apparent that the above-described apparatus and method of applying composite plating meet all of the objects mentioned above and also have the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of applying composite plating on an internal surface of a hollow member, comprising the steps of:

(a) providing an apparatus for applying composite plating on an internal surface of a hollow member comprising:

an electrode which is inserted into the hollow member with a predetermined clearance to an internal surface of the hollow member, the hollow member being held in a condition in which a generatrix of the internal surface extends vertically;

a composite plating liquid supply passage having a discharge opening which is in communication with an opening at a lower end of the hollow member;

means for entraining bubbles of a gas into a composite plating liquid which is supplied into the clearance through said supply passage;

wherein said discharge opening is provided with a restricted passage portion whose internal diameter is equal to or smaller than an outer diameter of said electrode; and wherein a lower end portion of said electrode is made gradually smaller in diameter towards the lower end thereof;

(b) flowing a composite plating liquid through the clearance so as to carry out the composite plating;

(c) entraining a gas, with the means for entraining, into the composite plating liquid in a bubbled condition before the composite plating liquid reaches the clearance, said gas being entrained in an amount corresponding to 12 to 95% by volume of the composite plating liquid.

2. A method of applying composite plating according to claim 1, wherein only the composite plating liquid is supplied into the clearance for a predetermined period of time, whereby a thin composite plating layer is formed on the internal surface of the hollow member, and wherein air which is used as said gas is thereafter entrained in a bubbled condition into the composite plating liquid, whereby the composite plating layer grows to a predetermined thickness.

3. A method of applying composite plating according to claim 1, wherein the gas is entrained in bubbles of such a size as will contact, when they enter the clearance, both the internal surface and the surface of the electrode and wherein the gas is entrained intermittently.

4. An apparatus for applying composite plating on an internal surface of a hollow member comprising:

an electrode which is inserted into the hollow member with a predetermined clearance to an internal surface of the hollow member, the hollow member being held in a condition in which a generatrix of the internal surface extends vertically;

a composite plating liquid supply passage having a discharge opening which is in communication with an opening at a lower end of the hollow member;

means for entraining bubbles of a gas into a composite plating liquid which is supplied into the clearance through said supply passage;

wherein said discharge opening is provided with a restricted passage portion whose internal diameter is equal to or smaller than an outer diameter of said electrode; and wherein a lower end portion of said electrode is made gradually smaller in diameter towards the lower end thereof.

5. An apparatus for applying composite plating according to claim 4, wherein said means for supplying a composite plating liquid comprises a gas entraining passage arranged to supply the gas at substantially right angles to the flow direction of the composite plating liquid.

6. An apparatus for applying composite plating according to claim 4, wherein said means for supplying a composite plating liquid comprises a gas entraining passage arranged to supply the gas in substantially the same direction as the flow direction of the composite plating liquid.

7. An apparatus for applying composite plating on an internal surface of a hollow member comprising:

an electrode which is inserted into the hollow member with a predetermined clearance to an internal surface of the hollow member, the hollow member being held in a condition in which a generatrix of the internal surface extends vertically;

a composite plating liquid supply passage having a discharge opening which is in communication with an opening at a lower end of the hollow member;

means for entraining bubbles of a gas into a composite plating liquid which is supplied into the clearance through said supply passage; and wherein said means for supplying a composite plating liquid comprises two gas entraining passages which are disposed to face each other at a predetermined distance between a front end of each, said gas entraining passages being disposed substantially at right angles to the flow direction of the composite plating liquid.

* * * * *